US012409968B2

(12) United States Patent
Leidig et al.

(10) Patent No.: US 12,409,968 B2
(45) Date of Patent: Sep. 9, 2025

(54) DEVICE FOR REMOVING A STERILE OBJECT FROM AN OUTER PACKAGING, A SYSTEM COMPRISING A CORRESPONDING DEVICE, AND A METHOD FOR REMOVING A STERILE OBJECT FROM AN OUTER PACKAGING

(71) Applicant: Syntegon Technology GmbH, Waiblingen (DE)

(72) Inventors: Juergen Leidig, Frankenhardt (DE); Florian Weber, Crailsheim (DE); Alexander Ekkart, Crailsheim (DE)

(73) Assignee: Syntegon Technology GmbH, Waiblingen (DE)

( * ) Notice: Subject to any disclaimer, the term of this patent is extended or adjusted under 35 U.S.C. 154(b) by 89 days.

(21) Appl. No.: 18/496,020

(22) Filed: Oct. 27, 2023

(65) Prior Publication Data

US 2024/0150061 A1 May 9, 2024

(30) Foreign Application Priority Data

Nov. 3, 2022 (DE) ..... 10 2022 129 107.3

(51) Int. Cl.
*B65B 69/00* (2006.01)

(52) U.S. Cl.
CPC ..... *B65B 69/0008* (2013.01); *B65B 69/00* (2013.01); *B65B 69/0041* (2013.01); *B65B 69/0033* (2013.01)

(58) Field of Classification Search
CPC . B65B 69/00; B65B 69/0008; B65B 69/0033; B65B 69/0041; B65B 69/0058; B 65H 5/226; B65H 5/06; B65H 5/222; B65H 2404/00–15; B65H 2404/1115; B65H 27/00
See application file for complete search history.

(56) References Cited

U.S. PATENT DOCUMENTS 2,730,254 A * 1/1956 Sabaroff ..... B65B 69/0041 414/412
4,034,877 A * 7/1977 Bennison ..... B65B 69/0008 414/412
4,158,417 A * 6/1979 Inoue ..... B65B 69/0033 414/412

(Continued)

FOREIGN PATENT DOCUMENTS

CA 2741247 C * 4/2017 ..... B65B 69/0008
CN 104816847 B * 2/2019 ..... A61M 5/002

(Continued)

OTHER PUBLICATIONS

European Patent Office Extended Search Report for Application No. 23204430.5 dated May 14, 2024 (11 pages including English machine translation).

(Continued)

*Primary Examiner* — Robert F Long
*Assistant Examiner* — Eduardo R Ferrero
(74) *Attorney, Agent, or Firm* — Michael Best & Friedrich LLP

(57) ABSTRACT

A device (1) for removing a sterile object (2) from an outer packaging (3), a system with a corresponding device (1) and a method for removing a sterile object (2) from an outer packaging (3) are proposed.

17 Claims, 6 Drawing Sheets

(56) References Cited

U.S. PATENT DOCUMENTS 4,219,299 A * 8/1980 Watson ..... B65B 69/0033 414/412
4,390,135 A * 6/1983 Wakamatsu ..... B02C 18/16 83/435
4,515,509 A * 5/1985 Frisz ..... B65B 69/0008 414/412
4,917,283 A * 4/1990 Weatherhead ..... B65H 45/14 226/190
5,222,600 A * 6/1993 Stoddard ..... B65D 33/24 206/439
5,352,082 A * 10/1994 Bennison ..... B23D 53/02 414/412
5,590,777 A * 1/1997 Weiss ..... B65D 75/5855 206/439
5,613,824 A * 3/1997 Kato ..... B65B 69/0008 141/330
5,947,287 A * 9/1999 Weiss ..... B65D 75/5855 206/439
6,089,814 A * 7/2000 Bayer ..... B65B 69/0008 414/412
6,223,578 B1 * 5/2001 Kamijo ..... B21D 28/06 29/893.33
6,251,489 B1 * 6/2001 Weiss ..... A61B 50/30 206/439
6,488,279 B1 * 12/2002 Fukuda ..... B65H 29/14 271/272
9,266,314 B2 * 2/2016 Findley ..... B65G 47/848
10,829,259 B2 * 11/2020 Nehus ..... B65D 83/771
2003/0185703 A1 * 10/2003 Walsh ..... A61L 2/07 422/26
2003/0230847 A1 * 12/2003 Shikahama ..... B65H 27/00 271/264
2004/0251617 A1 * 12/2004 Tsukada ..... B65H 5/062 271/272
2013/0269164 A1 * 10/2013 DeHart ..... B65B 69/0033 29/700
2016/0194187 A1 * 7/2016 Greadington ..... B65B 69/0008 53/381.2
2021/0107693 A1 4/2021 Palumbo et al.
2022/0227522 A1 7/2022 Kupfer et al.

FOREIGN PATENT DOCUMENTS

CN 114631840 A * 6/2022 ..... A61B 50/30
CN 106927098 B * 11/2022 ..... B02C 1/005
CN 116674833 A * 9/2023 ..... B65B 69/0008
CN 117244905 A * 12/2023
DE 102007027878 12/2008
DE 102011080289 2/2013
DE 102011084302 A1 4/2013
DE 102014201814 A1 8/2015
DE 102019206449 11/2020
EP 2110331 A2 * 10/2009 ..... B65B 69/00
JP 2016169017 A * 9/2016
NL 1027106 4/2006
RU 897647 A1 * 10/1979
RU 1284895 A1 * 1/1987

OTHER PUBLICATIONS

Office Action for German Application No. 10 2022 129 107.3 mailed on May 3, 2023 (Statement of Relevance, 9 pages).

* cited by examiner

DEVICE FOR REMOVING A STERILE OBJECT FROM AN OUTER PACKAGING, A SYSTEM COMPRISING A CORRESPONDING DEVICE, AND A METHOD FOR REMOVING A STERILE OBJECT FROM AN OUTER PACKAGING

BACKGROUND

The present invention relates to a device for removing a sterile object from an outer packaging. In addition, the present invention relates to a system comprising a corresponding device and a sterile object packaged in an outer packaging. Further, the present invention relates to a method for removing a sterile object from an outer packaging.

Sterile objects are used extensively, particularly in pharmaceutical production. Sterile objects are often transported and stored in outer packaging. One example of sterile objects is sterile tubs, which are conventionally packaged in an outer packaging in the form of a foil bag. A tub refers to a plastic tub used for storing nests or the like. A nest in the present sense is a plastic carrier plate and is typically used to hold primary packaging materials such as vials, syringes or carpules, particularly for medical agents, or other laboratory supplies such as plunger stoppers for syringes. Often, the foil bag with the sterile tub placed inside is first evacuated and then sealed.

Typically, sterile objects are handled automatically in a sterile environment. Removing a sterile object from its outer packaging is a demanding handling step because the sterile nature of the object must be maintained. In addition, no residues of the outer packaging should adhere to the sterile object after removal. A conventional device for removing a sterile object from an outer packaging is known, for example, from the disclosure document DE 10 2007 027 878 A1. The device has a tensioning device with two rotatable tensioning rollers. During a removal process, a first section of the outer packaging is clamped between the tensioning rollers. The outer packaging is then tensioned by rotating the tensioning rollers. A cut is then made in the tensioned outer packaging by means of a cutting device, and the sterile object is removed from the outer packaging through the cut by means of a removal device.

In the case of the device known from the document DE 10 2007 027 878 A1, problems can arise during the removal process which affect the cutting process and the removal itself. For example, a vacuum in the outer packaging can cause gas to suddenly flow into the outer packaging when the outer packaging is cut. This can lead to deformation of the outer packaging during cutting, which makes it at least more difficult to produce a precise desired cut. In addition, the outer packaging may adhere to the sterile object. This makes the removal itself more difficult, because the static friction between the outer packaging and the sterile object must be overcome.

SUMMARY

The invention is based on the task of providing a possibility to remove a sterile object from an outer packaging in a sterile environment, whereby a precise cutting of the outer packaging and an easy removal of the sterile object should be given.

This task is solved according to the invention by a device 1, by a system and by a method.

According to the invention, therefore, a device is provided for removing a sterile object, in particular a tub, from an outer packaging, in particular a foil bag. The device comprises a tensioning device with a rotatable tensioning roller and a further tensioning element. A first section of the outer packaging, in particular in the form of a flap, can be clamped between the tensioning roller and the further tensioning element. When the first section is clamped, the outer packaging can be tensioned by rotating the tensioning roller. Preferably, the tensioning roller is displaceable relative to the further tensioning element. This allows the first section to be clamped, for example, by lowering or raising the tensioning roller between the tensioning roller and the further tensioning element. Preferably, a controllable actuator for displacing the tensioning roller relative to the further tensioning element is associated with the tensioning roller. The further tensioning element is preferably a rotatable further tensioning roller. However, the further tensioning element can also be a stationary curved tensioning plate or the like. Preferably, the tensioning roller is assigned a controllable actuator for rotating the tensioning roller.

The device further comprises a cutting device for cutting open the tensioned outer packaging. Preferably, the cutting device is designed to cut open the outer packaging in such a way that the outer packaging remains a coherent part. Cutting the outer packaging into two separate parts is then avoided. This facilitates handling of the cut outer packaging during the subsequent removal of the sterile object.

The device further comprises a removal device for removing the sterile object from the outer packaging. Preferably, the removal device comprises at least one suction device for sucking in the sterile object during removal. Such a removal device is particularly suitable for the removal of tubs. Tubs generally comprise at least substantially flat side walls which can be easily aspirated.

It is now provided that at least one piercing element is arranged on the tensioning roller, which comprises a gas supply channel with at least one inlet opening for supplying gas into the gas supply channel and at least one outlet opening. The piercing element can be pierced into the outer packaging, in particular by rotating the tensioning roller. Once the piercing element is pierced into the outer packaging, gas can be blown into the outer packaging via the outlet opening of the piercing element to fill the outer packaging with gas. By blowing in gas, an abrupt inflow of gas into the outer packaging can be avoided when the outer packaging is later cut. In addition, the outer packaging can be detached from the sterile object by blowing in gas. This facilitates the removal of the sterile object, because at most a slight static friction between the sterile object and the outer packaging must be overcome. Preferably, the piercing element is hollow so that the gas supply channel extends through the piercing element. However, the gas supply channel can also extend at least in sections along an outer contour of the piercing element.

Preferably, the device comprises a gas supply device having a pressurized gas source, wherein the pressurized gas source is fluidically connected to the inlet opening of the gas supply channel. The pressurized gas source is configured to provide gas at a gas pressure above atmospheric pressure. Preferably, nitrogen, sterile compressed air, inert gas, etc. is used or provided. Preferably, the gas supply device comprises a valve unit with a pressure control valve, by means of which the gas pressure of the supplied gas can be controlled to a desired pressure value. This can prevent excessive or uncontrolled inflation of the outer packaging.

According to a preferred embodiment, it is provided that the tensioning roller is tubular with a cavity extending along its length, and that the cavity is fluidically connected to the inlet opening of the gas supply channel. In this embodiment, the gas is supplied to the gas supply channel through the cavity of the tensioning roller. Such a supply of gas is simple to implement in terms of design. In particular, the cavity of the tensioning roller can also be used for the fluidic connection of a plurality of piercing elements. Separate fluid lines for the individual piercing elements are not necessary. Preferably, the aforementioned pressurized gas source is fluidically connected to the cavity of the tensioning roller, so that the inlet opening of the gas supply channel is fluidically connected to the pressurized gas source through the cavity.

According to a preferred embodiment, the piercing element is arranged in a through-opening, in particular throughbore, of a shell wall of the tensioning roller. The arrangement in the through-opening ensures on the one hand the fluidic connection of the cavity of the tensioning roller with the inlet opening of the gas supply channel. In addition, the arrangement in the through-opening maintains a mechanically robust bond between the tensioning roller and the piercing element or elements. Preferably, the piercing element is pressed into the through-opening so that the piercing element is held in the through-opening by an interference fit. Preferably, an in particular circumferential projection of the piercing element rests against a stop step of the through-opening. The through-opening is thus stepped. The contact of the projection with the stop step prevents displacement of the piercing element in the radial direction. Preferably, a stop surface of the stop step is directed radially outward, so that the stop step blocks a displacement of the piercing element radially inward. Preferably, a sealing ring is provided which acts as a seal between the through-opening and the outer contour of the piercing element.

According to a preferred embodiment, the piercing element comprises a conical end portion, and the outlet opening is formed in the end portion spaced from the tip of the end portion. Due to the conical end portion, a mechanically robust piercing element can be realized, in particular compared to a piercing element having a needle-shaped end portion. The arrangement of the outlet opening at a distance from the tip in the conical end portion also ensures that the gas stream flowing out of the outlet opening has a tangential direction component relative to the axis of rotation of the tensioning roller. This makes it possible to achieve particularly effective detachment of the outer packaging from the sterile object. Preferably, there are a plurality of outlet openings which are formed in the end portion distributed in the circumferential direction of the end portion. This further improves the detachment of the outer packaging from the sterile object. Preferably, the outlet openings are formed axially at the same height in the end portion with respect to the longitudinal center axis of the piercing element.

Preferably, the further tensioning element has a circumferential groove radially opposite the piercing element. The circumferential groove ensures that the piercing element does not come into contact with the further tensioning element when the tensioning roller is rotated. Instead, the piercing element projects radially into the circumferential groove depending on the rotational position of the tensioning roller. Contact between the piercing element and the further tensioning element could lead to damage to the piercing element and/or the further tensioning element.

According to a preferred embodiment, it is provided that several piercing elements are arranged on the tensioning roller, in particular wherein at least two piercing elements are arranged one behind the other in the circumferential direction of the tensioning roller, in particular wherein at least two piercing elements are arranged one behind the other with respect to a longitudinal center axis of the tensioning roller. Preferred features disclosed above and below in connection with a piercing element are preferably implemented in all piercing elements if several piercing elements are present. Various advantages can be realized by the presence of multiple piercing elements, as will be explained below. If only a single piercing element is present, piercing of the piercing element into the outer packaging is only possible in a limited range of rotational positions of the tensioning roller. However, if there are at least two piercing elements arranged one behind the other in the circumferential direction of the tensioning roller, the rotational position range of the tensioning roller can be increased in which piercing of at least one of the piercing elements into the outer packaging is possible. If there are at least two piercing elements arranged one behind the other with respect to the longitudinal center axis of the tensioning roller, gas can be introduced into the outer packaging at different points with respect to the longitudinal extension of the tensioning roller. This is particularly effective in detaching the outer packaging from the sterile object.

Preferably, at least one elastically deformable ring element is arranged on the tensioning roller. The elastically deformable ring element can increase the static friction between the tensioning roller and the clamped first section of the outer packaging. Accordingly, the ring element causes a rotation of the tensioning roller to be reliably converted into a tensioning of the outer packaging when the first section is clamped. Preferably, several elastically deformable ring elements are present, which are arranged one behind the other on the tensioning roller in relation to the longitudinal extension of the tensioning roller.

Preferably, the device comprises a holding device for holding a flat section of the outer packaging, in particular one that extends horizontally. The holding device can improve the handling of the outer packaging, for example during the tensioning of the outer packaging and/or during the removal of the sterile object from the cut outer packaging. Depending on the design of the holding device, the holding device can interact with the flat section of the outer packaging in various ways, as will be explained in more detail below.

According to a preferred embodiment, the holding device comprises at least one suction element for sucking in the flat section of the outer packaging, in particular wherein the suction element is arranged on a supporting structure of the holding device. The suction element is designed to suck in the flat section by means of negative pressure. This allows the position of the flat section to be securely fixed when the outer packaging is cut open. In addition, the cut created in the outer packaging can be held open, facilitating removal of the sterile object from the cut-open outer packaging. Preferably, the holding device comprises several suction elements arranged in a distributed manner for sucking up the flat section.

According to a preferred embodiment, the holding device comprises a vertically displaceable hold-down device, in particular a hold-down sheet, for applying a compressive force to the flat section of the outer packaging. The hold-down device can be used to control the inflation of the outer packaging. When the outer packaging is inflated, the flat section comes to rest against the hold-down device. The movable hold-down device then applies the compressive force acting in the direction of the sterile object or vertically downwards to the flat section. This compressive force must be overcome for further bulging of the flat section. The design of the hold-down device as a hold-down sheet has the advantage that the compressive force acts in a distributed manner in the horizontal direction on the flat section. Preferably, the hold-down device is held displaceably on the supporting structure. This means that the components of the holding device can be easily handled together as an assembly.

Preferably, the device has a spring device which applies a spring force to the hold-down device acting in the direction of the flat section of the outer packaging. The previously mentioned compressive force is thus defined not only by the weight force of the hold-down device, but also by the spring force of the spring device. This has the advantage that a comparatively light hold-down device can be used for a compressive force with a desired height.

According to a preferred embodiment, it is provided that at least one of the suction elements protrudes through an opening or a recess of the hold-down device. In particular, when the hold-down device is designed as a flat hold-down sheet, a large part of the flat section of the outer packaging is occupied by the hold-down sheet. In the case of a closed hold-down sheet, only those areas of the flat section which lie laterally outside the outer contour of the hold-down sheet would be suitable for the arrangement of the suction elements. However, if at least one of the suction elements extends through an opening or recess in the hold-down device, a tensile force can also be applied to those areas of the flat section of the outer packaging which do not lie laterally outside the outer contour of the hold-down device.

According to a preferred embodiment, the device comprises at least one, in particular solid, piercing unit for piercing the flat section, in particular wherein the piercing unit is arranged on the supporting structure or on the hold-down device. By piercing the at least one piercing unit into the flat section, an opening is created in the flat section through which gas can escape from the outer packaging. This results in the outer packaging being inflated in a controlled and uniform manner via the at least one piercing element. Preferably, the piercing unit is arranged on the supporting structure in such a way that an end face of the hold-down device facing the flat section is arranged vertically below the tip of the piercing unit at least in a vertically lower end position of the hold-down device. In the vertically lower end position, the hold-down device prevents the piercing unit from piercing the flat section of the outer packaging. The piercing unit therefore does not pierce the flat section of the outer packaging until the outer packaging has already been inflated and the holding-down device has been moved vertically upwards.

The task to be solved is also solved by a system with the features according to the disclosure. The system comprises a sterile object, in particular a tub, which is packaged in an outer packaging, in particular a foil bag, and a device with the features described above for removing the sterile object from the outer packaging. Preferably, the first section of the outer packaging is formed as a flap. This makes it easy to clamp the first end portion by means of the tensioning device of the device. Preferably, the aforementioned supporting structure of the holding device of the device is formed complementary to the sterile object with respect to its shape. For example, if the sterile object is square in shape, the supporting structure is also square in shape and has approximately the same dimensions as the sterile object.

With regard to the advantages achievable with the system, reference is made to the explanations concerning the device or the method. The features described in connection with the device or the method can serve for the further design of the system.

The task to be solved is also solved by a method for removing a sterile object, in particular a tub, from an outer packaging, in particular a foil bag, wherein the method comprises at least the following steps:

Clamping of a first section, in particular a flap-shaped section, of the outer packaging between a rotatable tensioning roller and a further tensioning element, wherein at least one piercing element is arranged on the tensioning roller, which piercing element comprises a gas supply channel with at least one inlet opening and at least one outlet opening. Preferably, the first section is clamped between the tensioning roller and the further tensioning element by lowering or lifting the tensioning roller.

Tensioning the outer packaging by rotating the tensioning roller. Preferably, the first section is first clamped between the tensioning roller and the other tensioning element. Only then is the tensioning roller rotated to tension the outer packaging with the first section clamped. Alternatively, the tensioning roller is already rotated during clamping, so that the process steps "clamping the first section" and "tensioning the outer packaging" overlap in time.

Insertion of the piercing element into the outer packaging. Preferably, the piercing element is pierced into the outer packaging by rotating the tensioning roller. This is simple to implement in terms of design. In addition, the piercing of the piercing element can then be easily integrated into the process sequence, because the tensioning roller is rotated anyway to tension the outer packaging. However, the piercing element can also be assigned a controllable actuator which displaces the piercing element relative to the tensioning roller in order to insert the piercing element into the outer packaging.

Injection of gas through the outlet opening of the pierced piercing element into the outer packaging.

Cutting open the tensioned and inflated outer packaging and removing the sterile object from the outer packaging.

Advantages and further development possibilities of the device are to be understood as also described with respect to the method and, conversely, advantages and further development possibilities of the method are to be understood as also described with respect to the device.

According to a preferred embodiment of the process, it is provided that a flat section of the outer packaging, which extends in particular horizontally, is held by a holding device. This facilitates handling of the outer packaging.

Preferably, the flat section of the outer packaging is sucked in by at least one suction element of the holding device. Preferably, the suction element sucks in the flat section before the outer packaging is cut open, during the cutting open of the outer packaging and when the sterile object is removed from the cut outer packaging. Depending on the process step, various advantages are achieved by aspirating the flat section. Suctioning before cutting and during cutting can ensure the precise creation of a desired cut. Suction during removal can keep the created cut open, facilitating removal of the sterile object through the cut.

Preferably, the flat section is subjected to a vertically downwardly directed compressive force by a vertically displaceable hold-down device, in particular a hold-down sheet. The hold-down device allows the inflation of the outer packaging to be controlled.

According to a preferred embodiment of the method, it is provided that at least one, in particular solid, piercing unit is pierced into the flat section for pressure regulation. This allows the outer packaging to be inflated in a controlled and uniform manner. Specifically, the piercing of the piercing unit into the flat section creates an opening in the flat section through which the injected gas can slowly escape again from the outer packaging. Preferably, the piercing unit is pierced into the flat section while the gas is being injected. For example, the piercing unit is arranged in such a way that it only pierces the flat section after the outer packaging has been at least partially inflated.

BRIEF DESCRIPTION OF THE DRAWINGS

The invention is described in more detail below on the basis of the figures, whereby identical or functionally identical elements are, where appropriate, only marked once with reference signs. The description serves as an example and is not to be understood as restrictive. It shows FIG. 1 a schematic, perspective view of a device for removing a sterile object from an outer packaging.

DETAILED DESCRIPTION

Figure 1:
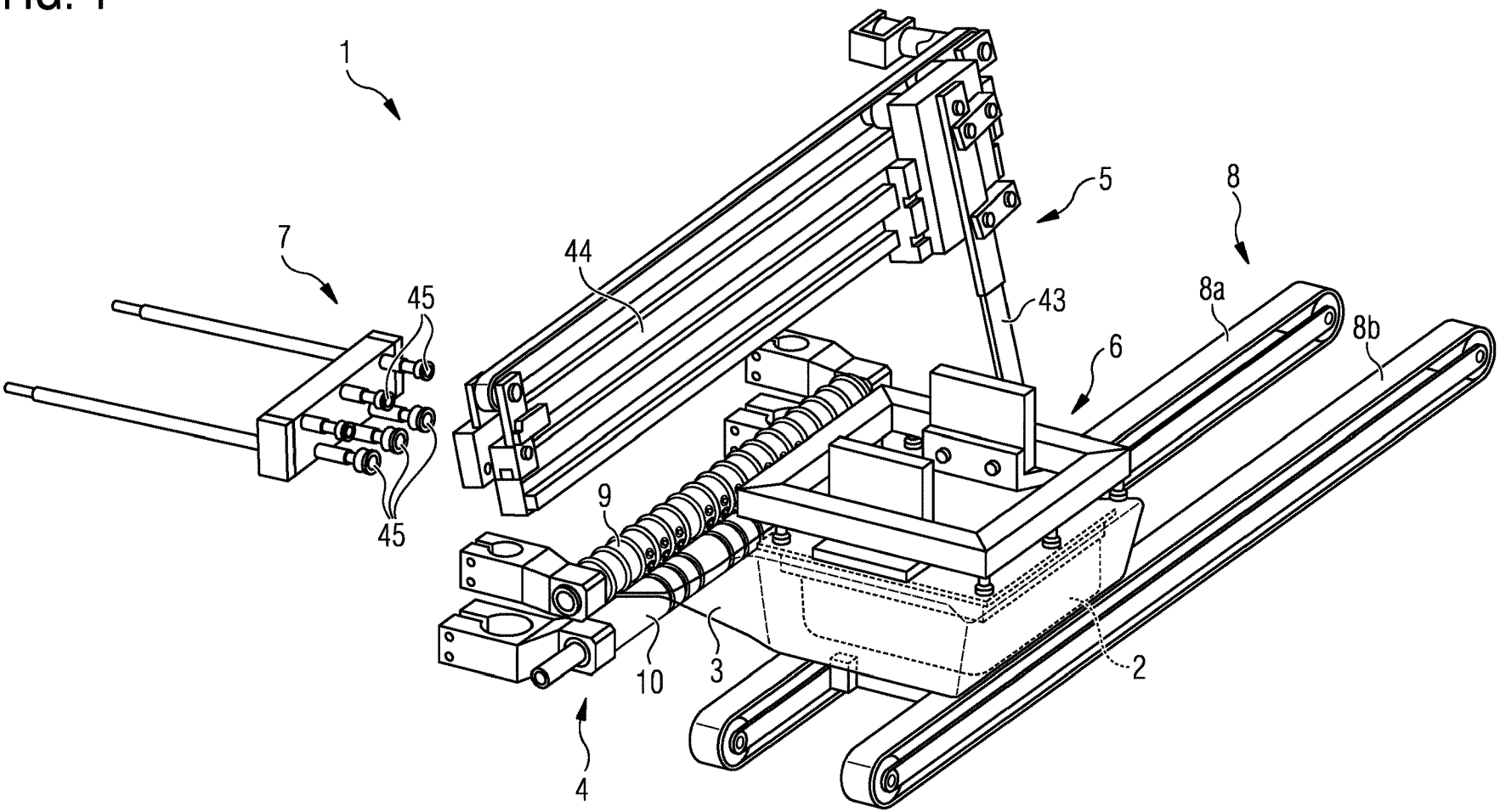

In the following, a device 1 for removing a sterile object 2 from an outer packaging 3 is described with reference to FIGS. 1 to 6. The outer packaging 3 is a foil bag 3. The foil bag 3 comprises a flap-shaped first section 11. The sterile object 2 is a sterile tub 2. A tub is a plastic tub. Tubs are used, for example, in pharmaceutical production for storing nests or the like. In the present case, the tub 2 is sealed in the evacuated foil bag 3.

FIG. 1 shows a schematic, perspective view of the device 1. The device 1 comprises a tensioning device 4, a cutting device 5, a holding device 6 and a removal device 7. The design of the devices 4, 5, 6 and 7 will be explained in more detail below. The device 1 also comprises a transport device 8 with two transport belts 8*a*, 8*b*. The transport device 8 serves to transport the outer packaging 3 with the sterile object 2 packaged therein into a removal area, in which a removal of the sterile object 2 from the outer packaging 3 takes place.

Figure 2:
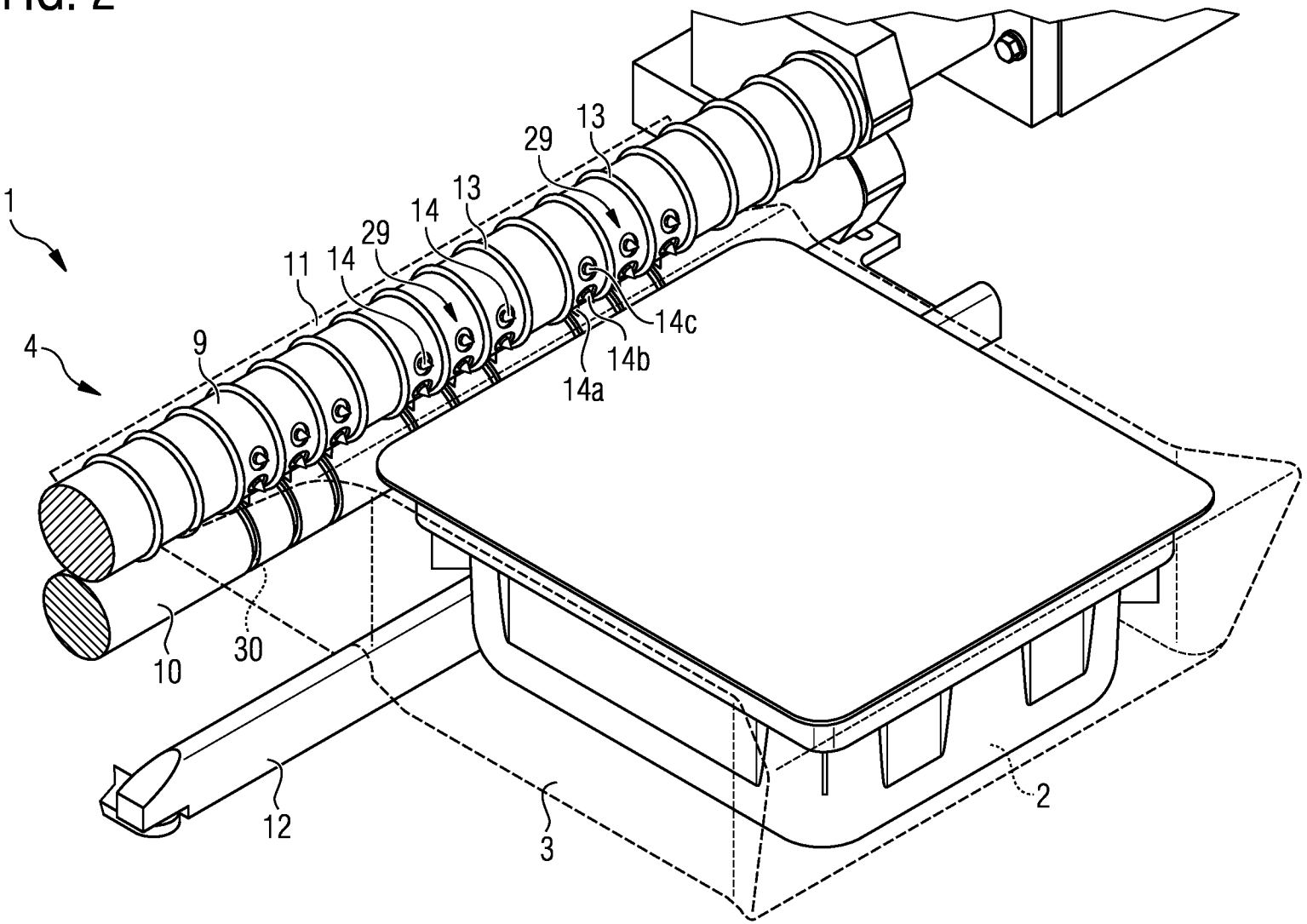
FIG. 2 another perspective view of the device.
Figure 3:
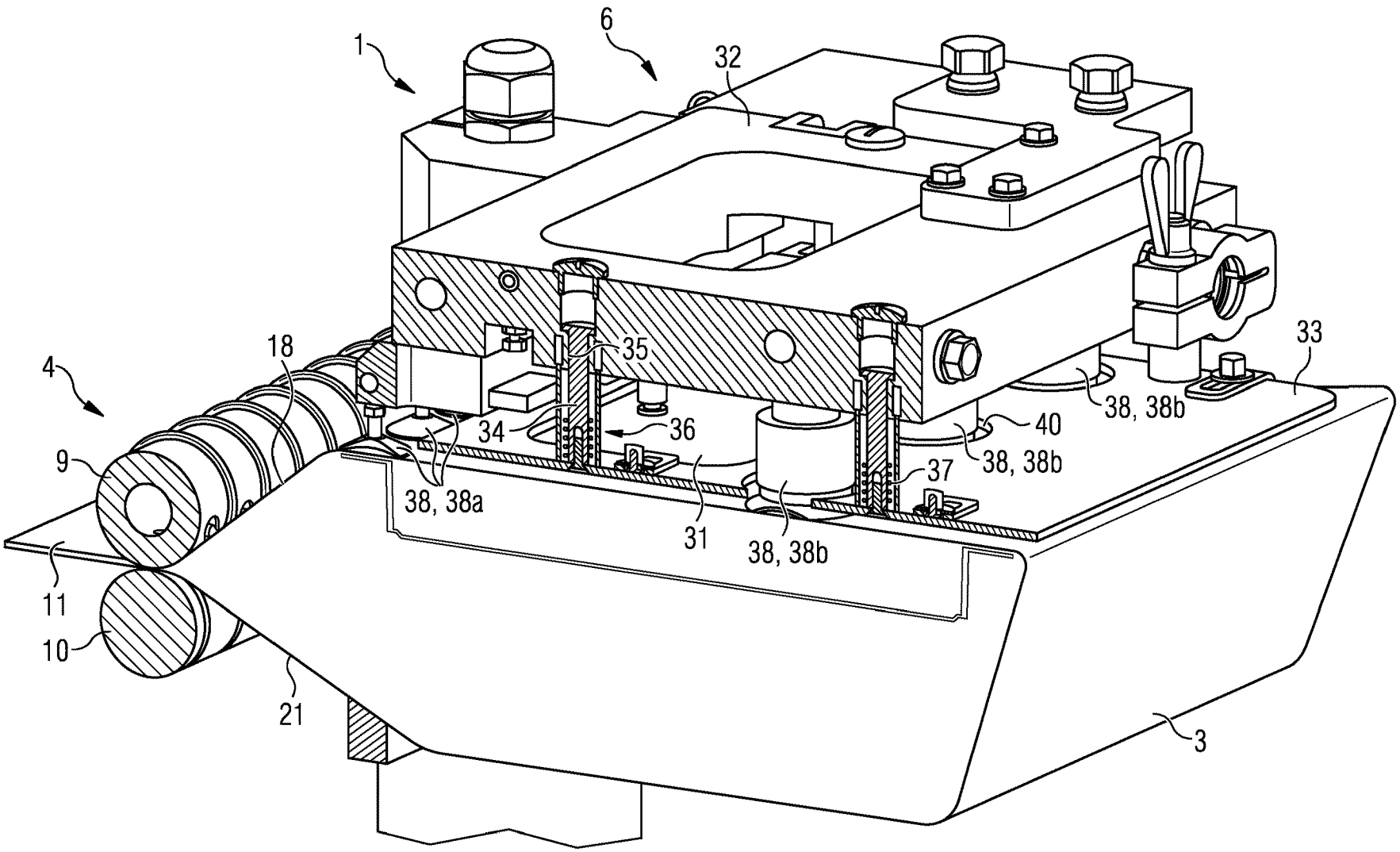
FIG. 3 a sectional view of the device.
Figure 4:
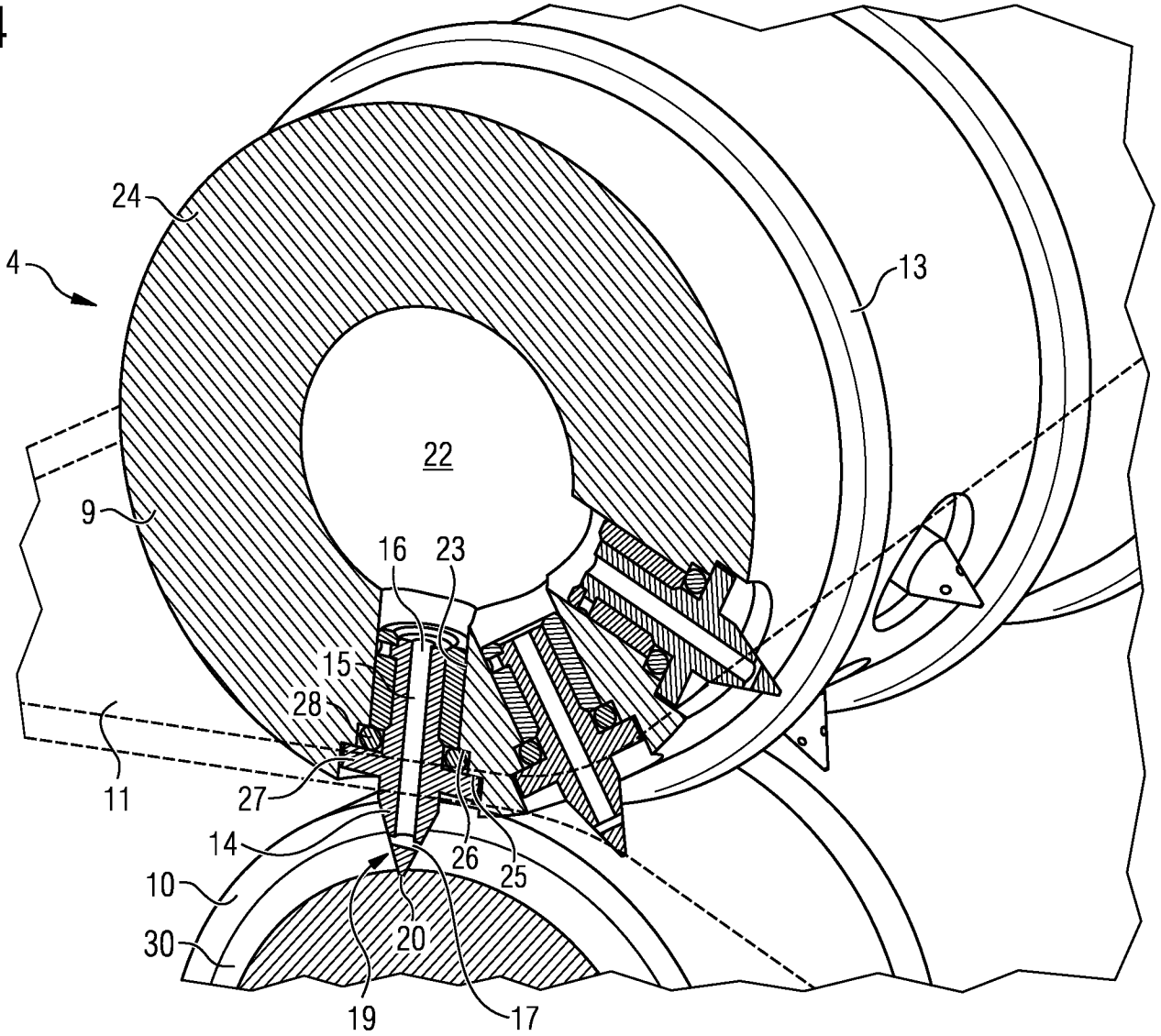
FIG. 4 a sectional view of a tensioning device of the device.

In the following, with additional reference to FIGS. 2, 3 and 4, the design of the tensioning device 4 is first explained in more detail. For this purpose, FIG. 2 shows a further perspective view of the device 1, whereby the representation of the holding device 6 has been omitted. It should be noted that in FIG. 2 the external outer packaging 3 is shown as a dashed line for the sake of clarity. FIG. 3 shows a sectional view of the device 1. FIG. 4 shows a sectional view of the tensioning device 4. The tensioning device 4 has a tensioning roller 9 which is mounted rotatably about its longitudinal center axis. A controllable actuator, which is not shown in more detail, is associated with the tensioning roller 9 for rotating the tensioning roller 9. The tensioning device 4 also has a further tensioning element 10. In the present case, the further tensioning element 10 is a further tensioning roller 10. The further tensioning roller 10 is also mounted rotatably about its longitudinal central axis. The tensioning roller 9 can be displaced vertically upwards and vertically downwards. For this purpose, a controllable actuator, not shown in more detail, is assigned to the tensioning roller 9 for displacing the tensioning roller 9. By displacing the tensioning roller 9, the distance between the tensioning roller 9 and the further tensioning element 10 can be increased or decreased. If the tensioning roller 9 is spaced apart from the further tensioning element 10, the flap-shaped first section 11 of the outer packaging 3 can be arranged between the tensioning roller 9 and the further tensioning element 10. By lowering the tensioning roller 9, the first section 11 can then be clamped between the tensioning roller 9 and the further tensioning element 10.

If the first section 11 is clamped between the tensioning roller 9 and the further tensioning element 10, the outer packaging 3 can be tensioned by rotating the tensioning roller 9. In the embodiment shown in the figures, a plurality of elastically deformable ring elements 13 are arranged on the tensioning roller 9. The ring elements 13 are arranged distributed along the longitudinal center axis of the tensioning roller 9. The ring elements 13 increase the static friction between the tensioning roller 9 and the clamped first section 11. This ensures that the rotation of the tensioning roller 9 is reliably converted into tensioning of the outer packaging 3. In order to prevent the outer packaging 3 with the sterile object 2 packaged therein from being pulled in the direction of the tensioning roller 9 and the further tensioning element 10 by the rotation of the tensioning roller 9, a rail-shaped blocking element 12 is provided in the present case. The locking element 12 rests by means of the outer packaging 3 on a side of the sterile object 3 facing the tensioning device 4 and thereby blocks a displacement of the sterile object 3 in the direction of the tensioning device 4.

Several piercing elements 14 are arranged on the tensioning roller 9. The design and function of the piercing elements 14 are explained in more detail below, with particular reference to the sectional view shown in FIG. 4.

As can be seen in FIG. 4, the piercing elements 14 each have a gas supply channel 15. In this case, the piercing elements 14 are hollow so that the gas supply channel 15 extends through the piercing elements 14. The gas supply channels 15 each have an inlet opening 16 and a plurality of outlet openings 17. The piercing elements 14 are arranged such that they can be pierced into the outer packaging 3 by rotating the tensioning roller 9 when the first section 11 is clamped. When a piercing element 14 is pierced into the outer packaging 3, gas can be blown into the outer packaging 3 through the outlet openings 17 of the pierced piercing element 14 to fill the outer packaging 3 with gas.

The piercing elements 14 each have a conical end portion 19. The outlet openings 17 are formed in the end portions 19 at a distance from the tips 20 of the end portions 19. In the present case, the outlet openings 17 of a piercing element 14 are arranged axially at the same height with respect to the longitudinal central axis of the piercing element 14 and are arranged uniformly distributed in the circumferential direction of the relevant end portion 19. In view of the previously described arrangement of the outlet openings 17, the gas flows flowing out of the piercing elements 14 have a tangential direction component with respect to the axis of rotation of the tensioning roller 9.

In the embodiment shown in the figures, the tensioning roller 9 is tubular with a cavity 22 extending along its length. A circumferential shell wall 24 of the tensioning roller 9 encloses the cavity 22 in the radial direction. The cavity 22 is fluidically connected to the inlet openings 16 of the gas supply channels 15. Gas can therefore be fed back to the gas supply channels 15 through the cavity 22.

In the embodiment shown in the figures, the piercing elements 14 are each arranged in a different through-opening 23 of the shell wall 24. The tips 20 of the piercing elements 14 project radially out of the through-openings 23. In the present case, the piercing elements 14 are pressed into the through-openings 23. The through openings 23 have a first stop step 25 and a second stop step 26. The stop surfaces of the stop steps 25 and 26 are each aligned radially outward with respect to the longitudinal center axis of the tensioning roller 9. The first stop step 25 is arranged radially outside the second stop step 26 with respect to the longitudinal center axis of the tensioning roller 9 and has a larger diameter than the second stop step 26. The piercing elements 14 each have a circumferential projection 27. The projections 27 rest against the first stop step 25 of the associated through-opening 23, whereby a radially inward displacement of the piercing elements 14 is blocked. A sealing element 28 is arranged between each of the projections 27 and the second stop steps 26. The sealing elements 28 bear sealingly against the stop surface of the relevant second stop step 26 on the one hand and the relevant projection 27 on the other.

In the embodiment shown in the figures, several piercing elements 14 are present. The arrangement of the piercing elements 14 will be explained in more detail below, with particular reference to FIG. 2. Specifically, twenty-seven piercing elements 14 are present in the present embodiment. The piercing elements 14 are arranged in nine rows 29 of three piercing elements 14 each. Each row 29 has a front piercing element 14*a* in the direction of rotation, a middle piercing element 14*b* in the direction of rotation, and a rear piercing element 14*c* in the direction of rotation. This has the advantage that piercing elements 14 can be inserted into the outer packaging 3 over a large rotational position range of the tensioning roller 9. For example, in the rotational position of the tensioning roller 9 shown in FIG. 3, the piercing elements 14*a* at the front in the direction of rotation are pierced into the outer packaging 3. The rear piercing elements 14*c* in the direction of rotation are arranged outside the outer packaging 3. The rows 29 are distributed along the longitudinal extent of the tensioning roller 9. This has the advantage that gas can be injected into the outer packaging 3 at various points along the longitudinal extent of the tensioning roller 9.

For each of the rows 29, the further tensioning element 10 has a circumferential groove 30, which is arranged axially at the same height as the associated row 29 in relation to the longitudinal center axis of the tensioning roller 9. The circumferential grooves 30 prevent contact between the tips 20 of the piercing elements 14 and the further tensioning element 10. Instead, depending on the rotational position of the tensioning roller 9, the piercing elements 14 merely project radially into the circumferential grooves 30.

Figure 5:
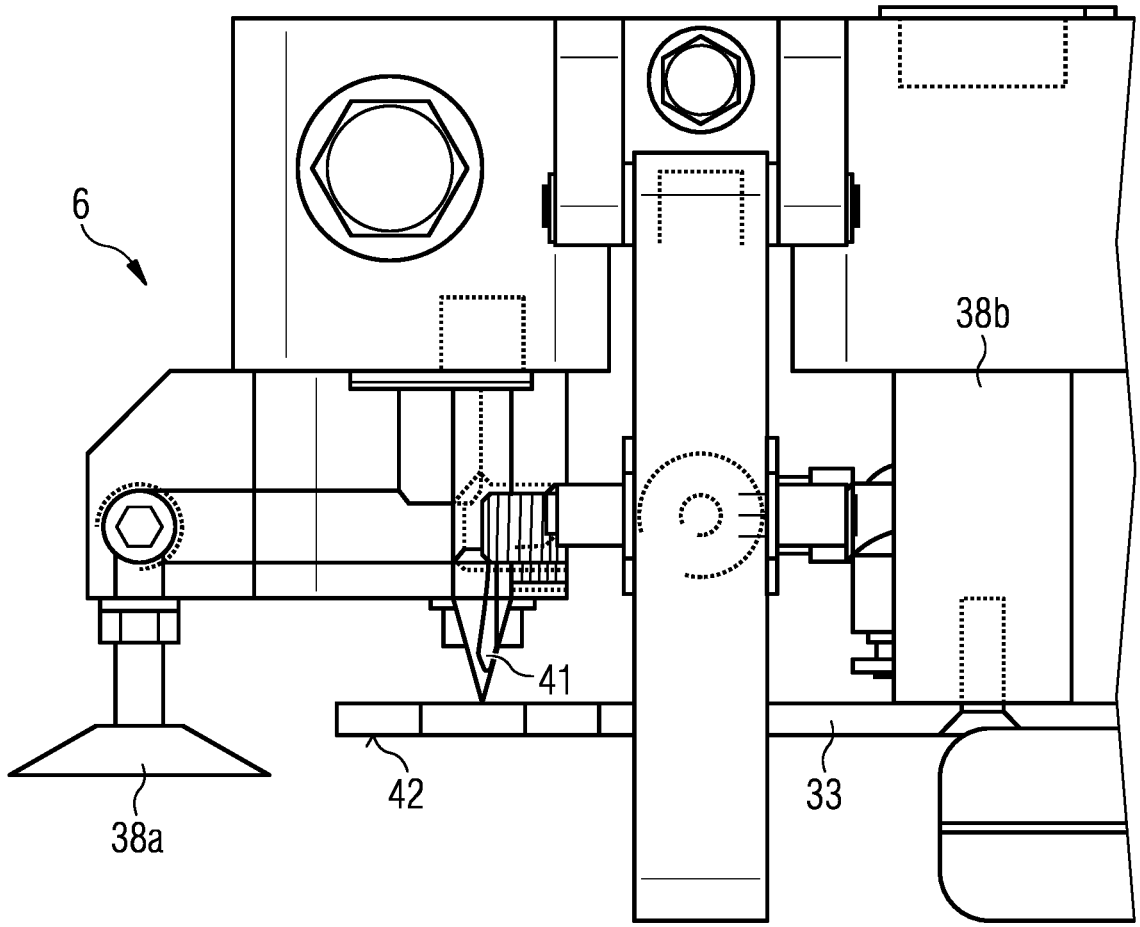
FIG. 5 a holding device of the device.

In the following, the design of the holding device 6 is explained in more detail with reference to FIGS. 3 and 5. During removal, the holding device 6 is located opposite a horizontally extended flat section 31 of the outer packaging 3. It should be noted that the structure of the holding device 6 shown in FIGS. 3 and 5 differs slightly from that of the holding device 6 shown in FIG. 1.

In the present case, the holding device 6 comprises a frame-shaped supporting structure 32. A hold-down device 33 is held vertically displaceably on the supporting structure 32. In the present case, the hold-down device 33 is designed as a flat hold-down sheet 33. A plurality of guide pins 34 are attached to the hold-down device 33, which protrude from the hold-down device 33 in the direction of the supporting structure 32, i.e. vertically upwards. The guide pins 34 project into through-openings 35 of the supporting structure 32 for guiding the hold-down device 33 on the supporting structure 32. In the present case, the hold-down device 33 can be displaced vertically upwards against the spring force of a spring device 36. Thus, in order to displace the hold-down device 33 vertically upward, the weight force of the hold-down device 33 and the spring force of the spring device 36 must be overcome. The spring device 36 comprises a plurality of spring elements 37, which are held preloaded between the hold-down device 33 and the supporting structure 32. In the present case, each of the spring elements 37 surrounds a respective different one of the guide pins 34.

The holding device 6 further comprises a plurality of suction elements 38. The suction elements 38 are configured to suck the flat section 31 of the outer packaging 3. The suction elements 38 can thus apply a vertically upwardly directed tensile force to the flat section 31. In the present case, a plurality of first suction elements 38*a* are arranged at an edge of the flat section 31 facing the tensioning device 4. In addition, a plurality of second suction elements 38*b* are provided. The second suction elements 38*b* project through a respective different aperture 40 of the hold-down device 33.

The device 1 further comprises at least one piercing unit 41 for piercing the flat section 31 of the outer packaging 3. In the present case, the piercing unit 41 is arranged on the supporting structure 32 in such a way that the piercing unit 41 extends vertically downwards from the supporting structure 32. When the outer packaging 3 is filled with gas by the piercing elements 14, the flat section 31 bulges vertically upwards. The piercing unit 41 then pierces the flat section 31, creating an opening in the flat section 31. In FIG. 5, an end face 42 of the hold-down device 33 facing the flat section 31 is arranged vertically below the tip of the piercing unit 41. Starting from this arrangement of the hold-down device 33, the hold-down device 33 must first be displaced vertically upwards through the flat section 31 before the piercing unit 41 then pierces into the flat section 31.

In the following, the design of the cutting device 5 is explained in more detail with reference to FIG. 1. The cutting device 5 comprises a knife 43, which in the present case is extended obliquely downward. The knife 43 can be moved horizontally via a linear guide 44 and is arranged in such a way that it can produce a cut in a third section 18 of the outer packaging 3 arranged between the first section 11 and the flat section 31. The knife 43 is also displaceable along its longitudinal extension, so that it can perform a sawing movement by simultaneous horizontal displacement and displacement along its longitudinal extension. This enables better cutting of the outer packaging 3.

In the following, the design of the removal device 7 is explained in more detail with reference to FIG. 1. The removal device 7 comprises several suction cups 45 and can be moved horizontally. As can be seen from FIG. 1, the removal device 7 is arranged laterally next to the sterile object 2 to be removed.

Figure 6:
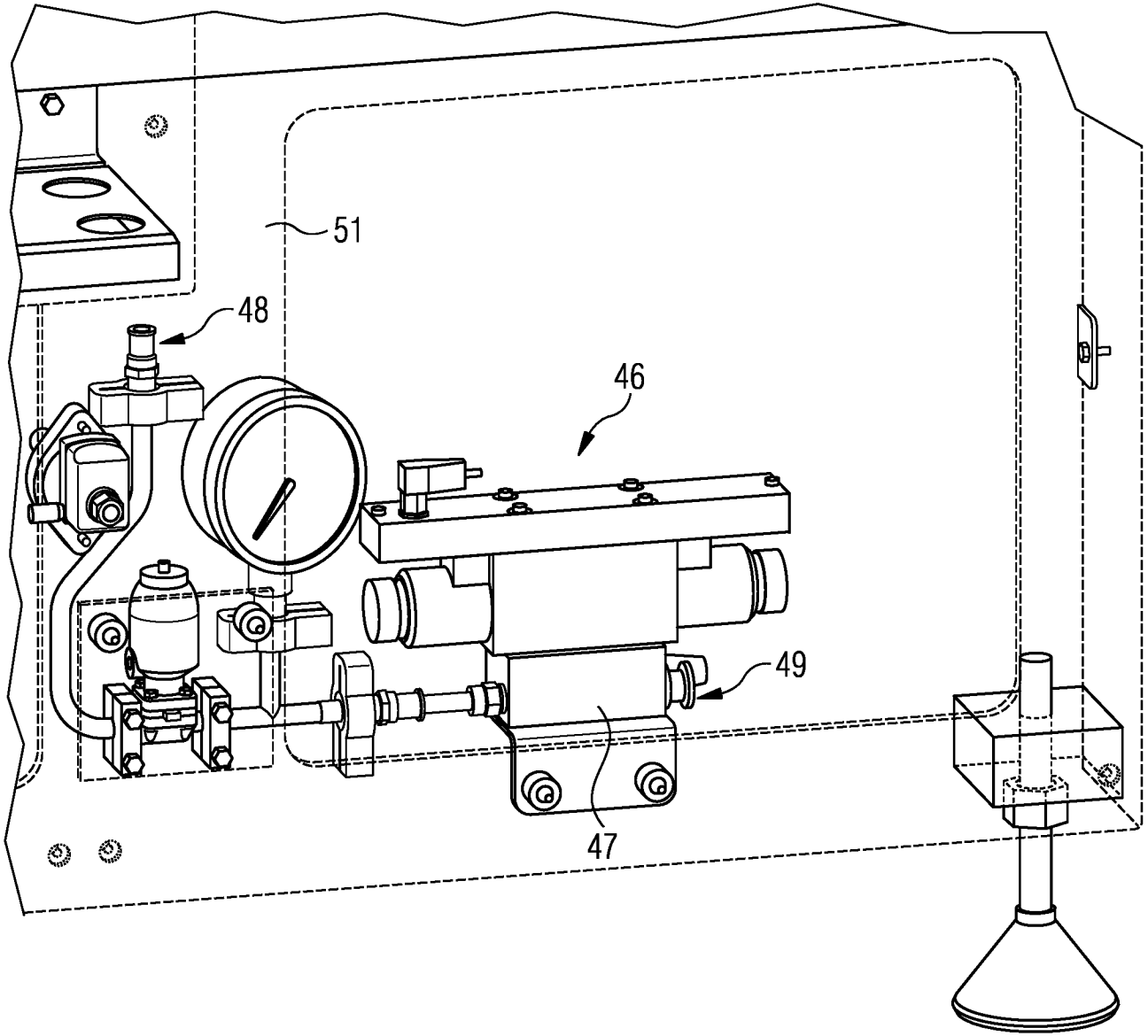
FIG. 6 a compressed gas supply device of the device.

The device 1 also has a gas supply device 46 shown in FIG. 6. The gas supply device 46 is integrated in a substructure 51 of the device 1. It should be noted that in FIG. 6 the substructure 51, which is in the foreground, is shown dashed for ease of reference. The gas supply device 46 has a valve unit 47 with a pressure control valve. The valve unit 47 has a gas inlet 48. The gas inlet 48 is fluidly connected or connectable to a source of pressurized gas not shown. The valve unit 47 further comprises a gas outlet 49. The gas outlet 49 is fluidically connected or connectable to the cavity 22 of the tensioning roller 9, for example by a pressure hose. Gas provided by the pressurized gas source can then be returned to the cavity 22 of the tensioning roller 9 to inject the gas into the outer packaging 3 via the piercing elements 14.

A method for removing the sterile object 2 from the outer packaging 3 by means of the device 1 is explained in more detail below. The sterile nature of the sterile object 2 is retained. First, the outer packaging 3 with the sterile object 2 packaged therein is brought into the removal area by the transport device 8.

If the outer packaging 3 with the sterile object 2 is in the removal area, the first section 11 of the outer packaging 3 is clamped by the tensioning device 4. For this purpose, the tensioning roller 9 is lowered so that the first section 11 is clamped between the tensioning roller 9 and the further tensioning element 10. If necessary, a guide element not shown is provided to guide the first section 11 between the tensioning roller 9 and the further tensioning element 10 when the outer packaging 3 is brought into the removal area.

In addition, the flat section 31 is sucked in by the suction elements 38 of the holding device 6. The outer packaging 3 is then held by the holding device 6.

The process steps "clamping of the first section 11" and "suction of the flat section 31" can be carried out both simultaneously and consecutively, whereby both the process step "clamping of the first section 11" and the process step "suction of the flat section 31" can be carried out first.

Once the first section 11 has been clamped by the tensioning device 4, the tensioning roller 9 is rotated to tension the outer packaging 3. Alternatively, the tensioning roller 9 is already rotated during lowering so that the process steps "clamping the first section 11" and "tensioning the outer packaging 3" are carried out overlapping in time. By rotating the tensioning roller 9, at least some of the piercing elements 14 are pierced into the outer packaging 3. Gas is then blown into the outer packaging 3 through the outlet openings 17 of the pierced piercing elements 14. Preferably, the gas supply device 46 already provides the gas before the piercing of the piercing elements 14, so that the gas also already flows out of the piercing elements 14 through the outlet openings 17 before the piercing. However, the gas flow can also be started after the piercing of the piercing elements 14. Preferably, nitrogen, sterile compressed air, inert gas, etc. is used or provided as the gas.

The blowing of gas into the outer packaging 3 causes the outer packaging 3 to inflate. This causes the flat section 31 to bulge out and lift the hold-down device 33. The piercing unit 41 is then pierced into the flat section 31, creating an opening in the flat section. As a result, gas can escape from the outer packaging 3 through the opening and the outer packaging 3 is inflated in a controlled and uniform manner by the piercing elements 14.

In a next step, the knife 43 is moved along the linear guide 44 in such a way that the knife 43 cuts a slit in the third section 18 of the outer packaging 3. The knife 43 is moved in such a way that it only cuts the third section 18 of the outer packaging 3, but not the section 21 arranged vertically below it. The first section 11 is therefore not separated from the outer packaging 3. Rather, the outer packaging 3 remains as a coherent part. The prior inflation of the outer packaging 3 facilitates the precise creation of a desired cut.

In a next step, the tensioning device 4 is lowered vertically with the clamped first section 11. Alternatively or additionally, the holding device 6 is raised with the suctioned flat section 31. Both have the effect that the cut is held open in the third section 18. Subsequently, the removal device 7 is moved horizontally through the cut which is held open and the sterile object 2 is sucked in by the suction cups 45 of the removal device 7. Finally, the removal device 7 is moved back horizontally, causing the sucked in sterile object 2 to be removed from the outer packaging 3. Because the outer packaging 3 has previously been inflated via the piercing elements 14, the outer packaging 3 does not adhere to the sterile object 2, or at most only slightly, which simplifies removal.

What is claimed is:

1. A device (1) for removing a sterile object (2) from an outer packaging (3), the device having a tensioning device (4) which comprises a rotatable tensioning roller (9) and a further tensioning element (10), wherein, during a removal process, a first section (11) of the outer packaging (3) can be clamped between the tensioning roller (9) and the further tensioning element (10), and wherein the outer packaging (3) can be tensioned by rotating the tensioning roller (9) when the first section (11) is clamped, having a cutting device (5) for cutting open the tensioned outer packaging (3), and with a removal device (7) for removing the sterile object (2) from the cut open outer packaging (3), wherein at least one piercing element (14) is arranged on the tensioning roller (9), which piercing element (14) has a gas supply channel (15) with at least one inlet opening (16) for supplying gas and at least one outlet opening (17), wherein the piercing element (14) can be pierced into the outer packaging (3) and gas can be blown into the outer packaging (3) via the outlet opening (17) of the pierced piercing element (14) in order to fill the outer packaging (3) with gas.

2. The device (1) according to claim 1, wherein the tensioning roller (9) is tubular with a cavity (22) extending along its length, and wherein the cavity (22) is fluidically connected to the inlet opening (16) of the gas supply channel (15).

3. The device (1) according to claim 1, wherein the piercing element (14) is arranged in a through-opening (23) of a shell wall (22) of the tensioning roller (9).

4. The device (1) according to claim 1, wherein the piercing element (14) comprises a conical end portion (19), and wherein the outlet opening (17) is formed in the end portion (19) at a distance from a tip (20) of the end portion (19).

5. The device (1) according to claim 1, wherein the further tensioning element (10) comprises a circumferential groove (30) radially opposite the piercing element (14).

6. The device (1) according to claim 1, wherein a plurality of piercing elements (14) are arranged on the tensioning roller (9).

7. The device (1) according to claim 1, wherein at least one elastically deformable ring element (13) is arranged on the tensioning roller (9).

8. The device (1) according to claim 1, further comprising a holding device (6) for holding a flat section (31) of the outer packaging (3).

9. The device (1) according to claim 8, wherein the holding device (6) comprises at least one suction element (38) for sucking in the flat section (31) of the outer packaging (3).

10. The device (1) according to claim 8, wherein the holding device (6) comprises a hold-down device (33) displaceable in the vertical direction, for applying a compressive force to the flat section (31) of the outer packaging (3).

11. The device (1) according to claim 10, further comprising a spring device (36) which applies to the hold-down device (33) a spring force acting in a direction of the flat section (31) of the outer packaging (3).

12. The device (1) according to claim 10, wherein at least one suction element (38) protrudes through an aperture (40) or a recess of the hold-down device (33).

13. The device (1) according to claim 1, further comprising at least one piercing unit (41) for piercing a flat section (31) of the outer packaging (3).

14. A system comprising a sterile object (2) which is packaged in an outer packaging (3), and a device (1) according to claim 1 for removing the sterile object (2) from the outer packaging (3).

15. A method for removing a sterile object (2) from an outer packaging (3) comprising the following steps:

a. Clamping of a first section (31) of the outer packaging (3) between a rotatable tensioning roller (9) and a further tensioning element (10), at least one piercing element (14) being arranged on the tensioning roller (9), which piercing element (14) comprises a gas supply channel (15) with at least one inlet opening (16) and at least one outlet opening (17), b. Tensioning the outer packaging (3) by rotating the tensioning roller (9), c. Piercing the piercing element (14) into the outer packaging (3), d. Injecting gas through the outlet opening (17) of the pierced piercing element (14) into the outer packaging (3), e. Cutting open the tensioned and inflated outer packaging (3), and f. Removing the sterile object (2) from the outer packaging (3).

16. The method according to claim 15, wherein a flat section (31) of the outer packaging (3) is held by a holding device (6).

17. The method according to claim 15, wherein at least one piercing unit (41) is pierced into the flat section (31) for pressure regulation.

* * * * *